US010035673B2

(12) United States Patent
Tani

(10) Patent No.: US 10,035,673 B2
(45) Date of Patent: Jul. 31, 2018

(54) IMAGE FORMING APPARATUS FOR FORMING IMAGE ON CONVEYED SHEET

(71) Applicant: CANON KABUSHIKI KAISHA, Tokyo (JP)

(72) Inventor: Masaki Tani, Kawasaki-shi (JP)

(73) Assignee: Canon Kabushiki Kaisha, Tokyo (JP)

( * ) Notice: Subject to any disclaimer, the term of this patent is extended or adjusted under 35 U.S.C. 154(b) by 40 days.

(21) Appl. No.: 15/177,655

(22) Filed: Jun. 9, 2016

(65) Prior Publication Data

US 2016/0370748 A1 Dec. 22, 2016

(30) Foreign Application Priority Data

Jun. 19, 2015 (JP) ..... 2015-124163
May 27, 2016 (JP) ..... 2016-106716

(51) Int. Cl.
*B65H 7/06* (2006.01)
*G03G 15/00* (2006.01)
*B65H 5/06* (2006.01)

(52) U.S. Cl.
CPC ..... *B65H 7/06* (2013.01); *B65H 5/062* (2013.01); *G03G 15/6529* (2013.01);
(Continued)

(58) Field of Classification Search
CPC .. G03G 15/6529; G03G 15/6564; B65H 7/02; B65H 7/06; B65H 7/20;
(Continued)

(56) References Cited

U.S. PATENT DOCUMENTS 5,407,191 A 4/1995 Ukai
5,813,327 A * 9/1998 Freeman ..... B65H 3/042 101/232
(Continued)

FOREIGN PATENT DOCUMENTS

JP 06-298403 A 10/1994
JP 08-190647 A 7/1996
(Continued)

OTHER PUBLICATIONS

Office Action dated Apr. 28, 2018, in Chinese Patent Application No. 201610422618.6.

*Primary Examiner* — Ernesto A Suarez
(74) *Attorney, Agent, or Firm* — Fitzpatrick, Cella, Harper & Scinto

(57) ABSTRACT

A conveyance unit conveys a sheet on a conveyance path. A first detection unit detects a sheet on the conveyance path. A determination unit determines an adjustment amount for adjusting an interval from a trailing end of a preceding sheet to a leading end of a succeeding sheet according to a difference between a measurement interval and a target interval. A correction unit corrects the adjustment amount according to a difference between a measurement value of a length of the preceding sheet in a conveyance direction and a reference value of the length of the preceding sheet in the conveyance direction. A control unit controls the conveyance unit such that a conveyance speed of the conveyance unit is accelerated or decelerated during a period of time that corresponds to the adjustment amount corrected by the correction unit.

17 Claims, 13 Drawing Sheets

(52) U.S. Cl.
CPC ..... *G03G 15/6564* (2013.01); *B65H 2511/11* (2013.01); *B65H 2511/22* (2013.01); *B65H 2511/528* (2013.01); *B65H 2513/20* (2013.01); *B65H 2553/612* (2013.01); *G03G 2215/00599* (2013.01)

(58) Field of Classification Search
CPC ..... B65H 2301/35; B65H 2301/4452; B65H 2301/44522; B65H 2511/11; B65H 2511/22; B65H 2513/20; B65H 2513/513; B65H 2553/612; B65H 5/34
See application file for complete search history.

(56) References Cited

U.S. PATENT DOCUMENTS

| | | | | | |
|---|---|---|---|---|---|
| 6,076,821 | A * | 6/2000 | Embry | B65H 7/18 | 271/10.01 |
| 6,126,160 | A * | 10/2000 | Ebert | B65H 5/34 | 271/10.03 |
| 8,590,883 | B2 * | 11/2013 | Asari | B65H 5/062 | 271/265.02 |
| 8,827,259 | B2 * | 9/2014 | Fujii | G03G 15/6564 | 271/10.02 |
| 9,348,289 | B2 * | 5/2016 | Obata | G03G 15/6529 | |
| 9,586,766 | B2 * | 3/2017 | Nakano | B65G 43/08 | |
| 2015/0028533 | A1 * | 1/2015 | Kato | B65H 7/14 | 271/3.16 |

FOREIGN PATENT DOCUMENTS

| | | | |
|---|---|---|---|
| JP | 11-290787 | A | 10/1999 |
| JP | 2002-132765 | A | 5/2002 |
| JP | 2003-306254 | A | 10/2003 |
| JP | 2004-035142 | A | 2/2004 |
| JP | 2005-103699 | A | 4/2005 |
| JP | 2006-016122 | A | 1/2006 |
| JP | 2006-089218 | A | 4/2006 |
| JP | 2007-119256 | A | 5/2007 |
| JP | 2012-020474 | A | 2/2012 |
| JP | 2014-040329 | A | 3/2014 |
| JP | 2015-016922 | A | 1/2015 |

* cited by examiner

IMAGE FORMING APPARATUS FOR FORMING IMAGE ON CONVEYED SHEET

BACKGROUND OF THE INVENTION

Field of the Invention

The present invention relates to an image forming apparatus and a sheet conveyance device. The present invention also relates to printing apparatuses, and in particular to image forming apparatuses such as copiers, laser beam printers, and facsimile machines.

Description of the Related Art

Japanese Patent Laid-Open No. 2002-132765 proposes measuring a sheet interval between a preceding sheet and a succeeding sheet before a sheet enters an image forming section, and adjusting the sheet interval by temporarily accelerating a paper feed motor according to a difference from a target interval. Consequently, it becomes possible to maintain the sheet interval to be a target interval. The sheet interval indicates the distance or the period of time from the trailing end of the preceding sheet to the leading end of the succeeding sheet. A sheet sensor is needed in order to measure the sheet interval. Japanese Patent Laid-Open No. 2014-40329 and Japanese Patent Laid-Open No. 2015-16922 propose a flag that rotates by being pressed by a sheet, and a photointerrupter that switches between a light transmitting state and a light blocking state in response to the rotation of the flag.

Sheet sensors for measuring the sheet interval are disposed at a downstream position and an upstream position in the conveyance path. The sheet sensor disposed at the upstream position is mainly used for maintaining the sheet interval between the preceding sheet and the succeeding sheet to be the target interval. On the other hand, the sheet sensor disposed at the downstream position is mainly used for detecting a jam (a paper jam). The sheet sensors include mechanical structures, and it is therefore impossible to detect the sheet interval unless the sheet interval is greater than or equal to a certain interval. For this reason, if the sheet interval obtained by the sheet sensor at the upstream position is erroneous, the sheet interval is excessively reduced by adjustment, and consequently, there are cases in which the sheet sensor at the downstream position cannot detect the sheet interval, and mistakenly detects that a jam has occurred. Conversely, if the sheet interval is excessively increased by adjustment, the throughput (the number of sheets on which images can be formed per unit time) decreases.

SUMMARY OF THE INVENTION

The present invention provides technology to more accurately control the sheet interval compared to conventional technology.

The present invention provides an image forming apparatus comprising: a conveyance unit configured to convey a sheet on a conveyance path; a first detection unit configured to detect a sheet on the conveyance path; a determination unit configured to determine an adjustment amount for adjusting an interval from a trailing end of a preceding sheet to a leading end of a succeeding sheet according to a difference between a measurement interval from the trailing end of the preceding sheet to the leading end of the succeeding sheet, measured based on a result of detection by the first detection unit, and a target interval; a correction unit configured to correct the adjustment amount according to a difference between a measurement value of a length of the preceding sheet in a conveyance direction, measured based on the result of detection by the first detection unit, and a reference value of the length of the preceding sheet in the conveyance direction; and a control unit configured to control the conveyance unit such that a conveyance speed of the conveyance unit is accelerated or decelerated during a period of time that corresponds to the adjustment amount corrected by the correction unit.

The present invention also provides a sheet conveyance device, comprising: a conveyance unit configured to convey a sheet on a conveyance path; a detection unit configured to detect a sheet on the conveyance path; a determination unit configured to determine an adjustment amount for adjusting an interval from a trailing end of a preceding sheet to a leading end of a succeeding sheet according to a difference between a measurement interval from the trailing end of the preceding sheet to the leading end of the succeeding sheet, measured based on a result of detection by the detection unit, and a target interval; a correction unit configured to correct the adjustment amount according to a difference between a measurement value of a length of the preceding sheet in a conveyance direction, measured based on the result of detection by the detection unit, and a reference value of the length of the preceding sheet in the conveyance direction; and a control unit configured to control the conveyance unit such that a conveyance speed of the conveyance unit is accelerated or decelerated during a period of time that corresponds to the adjustment amount corrected by the correction unit.

Further features of the present invention will become apparent from the following description of exemplary embodiments (with reference to the attached drawings).

DESCRIPTION OF THE EMBODIMENTS

Embodiment 1

Image Forming Apparatus

Figure 1:
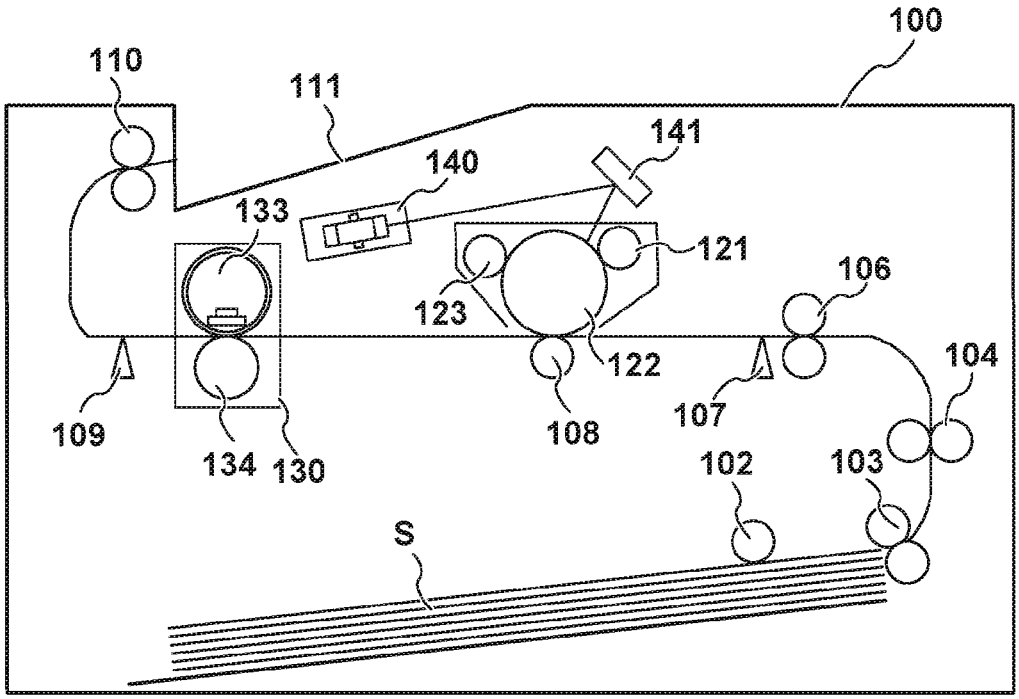
FIG. 1 is a cross-sectional view showing an example of an image forming apparatus.

FIG. 1 is a schematic cross-sectional view of an image forming apparatus 100. Although the image forming apparatus 100 according to the present embodiment is a printer that employs an electrophotographic method, an image forming apparatus to which the present invention can be applied may employ another image forming method such as an ink jet method or a thermal transfer method. A photosensitive drum 122 serves as a photosensitive member and an image carrier, and rotates in the clockwise direction at a predetermined circumferential speed (process speed) vps. A charging roller 123 uniformly charges the surface of the photosensitive drum 122. An optical scanning device 140 outputs a light beam according to an image signal. The optical beam is reflected by a reflection mirror 141, is applied to the surface of the photosensitive drum 122, and forms an electrostatic latent image. A developer roller 121 develops an electrostatic latent image by attaching toner thereto, and forms a toner image.

Sheets S housed in a paper feed cassette are picked up by a paper feed roller 102 and separated from each other by a separation roller 103, and each sheet S is fed to the conveyance path. A conveyance roller 104 and a registration roller 106 are examples of a conveyance unit that conveys a sheet in the conveyance path. The conveyance speeds of the conveyance roller 104 and the registration roller 106 are changeable. These conveyance speeds change, and accordingly the conveyance speed of the sheets S changes. Consequently, the sheet interval (so-called paper interval) from the trailing end of the preceding sheet to the leading end of the succeeding sheet is maintained to be the target interval. Note that the sheet interval adjustment may be performed by the conveyance roller 104 without involvement of the registration roller 106. The target interval is the sheet interval that has been determined in the design phase of the image forming apparatus 100 in order to achieve a desired throughput. The circumferential speed of the conveyance roller 104 disposed downstream of the registration roller 106 is maintained to be constant (the circumferential speed vps). In other words, when the leading end of a sheet S is located within a section from the conveyance roller 104 to the photosensitive drum 122 (or the registration roller 106), the conveyance speed of the sheet S is subjected to speed change control.

A transfer roller 108 and the photosensitive drum 122 convey the sheet S while sandwiching the sheet S, and thus the toner image on the photosensitive drum 122 is transferred onto the sheet S. A fixing device 130 has a fixing film 133 and a pressure roller 134. The sheet S is conveyed while being sandwiched between the fixing film 133 and the pressure roller 134, and thus the toner image is fixed. Then, the sheet S is fed to a discharge roller 110, and is discharged to a discharge tray 111. Note that the photosensitive drum 122, the transfer roller 108, the pressure roller 134, and the discharge roller 110 are also examples of the conveyance unit.

A plurality of sheet sensors for detecting sheets are disposed in the conveyance path. A top sensor 107 is an example of a first detection unit that is disposed at an upstream position in the conveyance path in the conveyance direction of the sheet S, and that detects the sheet S. The top sensor 107 is used for detecting the length of the sheet S in the conveyance direction, and detecting the sheet interval. A paper discharge sensor 109 is an example of a second detection unit that is dispose at a downstream position in the conveyance path in the conveyance direction of the sheet S, and that detects the sheet S. The paper discharge sensor 109 is mainly used for detecting a jam (paper jam) of the sheet S.

Drive Mechanism

Figure 2:
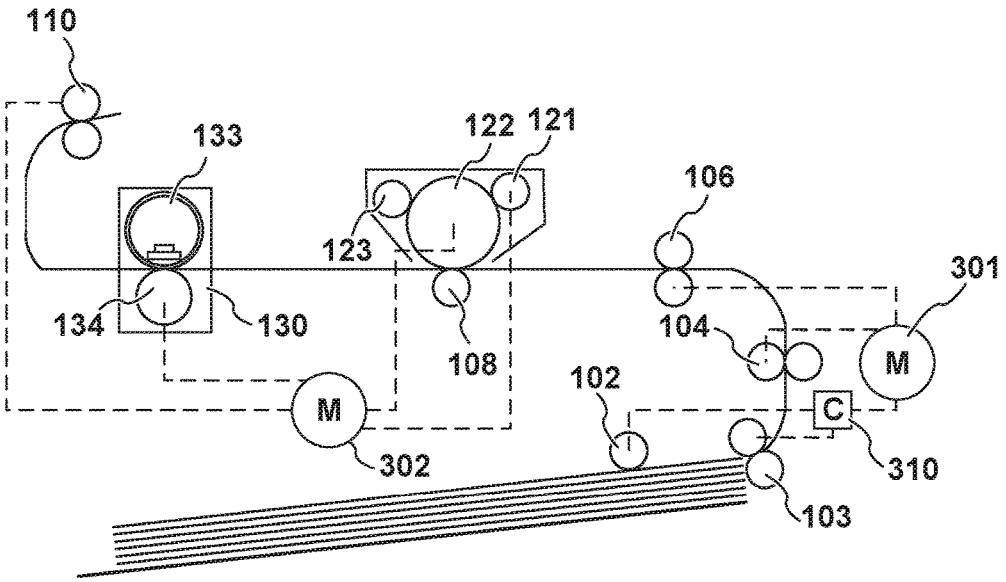
FIG. 2 is a diagram showing a relationship between rollers and motors.

FIG. 2 is a diagram showing a relationship between the rollers and the drive sources of the rollers. In the image forming apparatus 100, a paper feed motor 301 and a main motor 302 are used as drive sources. The paper feed motor 301 and the main motor 302 may also be interpreted as part of the conveyance unit. The paper feed motor 301 drives the paper feed roller 102 and the separation roller 103 via a paper feed clutch 310. Furthermore, the paper feed motor 301 drives the conveyance roller 104 and the registration roller 106. The main motor 302 drives the photosensitive drum 122, the developer roller 121, the pressure roller 134, and the discharge roller 110. The sheet interval is adjusted by controlling the rotation speed of the paper feed motor 301. Note that a stepping motor is employed as the paper feed motor 301 in order to facilitate description of the sheet interval adjustment by acceleration (hereinafter referred to as acceleration control). However, note that a DC brushless motor, a brush motor, or the like may also be adopted as the paper feed motor 301. During a period of time in which the sheet interval adjustment is not being performed, the circumferential speeds of the conveyance roller 104 and the registration roller 106 are also controlled so as to be the circumferential speed vps. Note that if the circumferential speed of the registration roller 106 is always controlled to be the circumferential speed vps, the registration roller 106 may be driven by the main motor 302. If this is the case, the sheet sensor for detecting the sheet interval is disposed near the conveyance roller 104.

Control System

Figure 3:
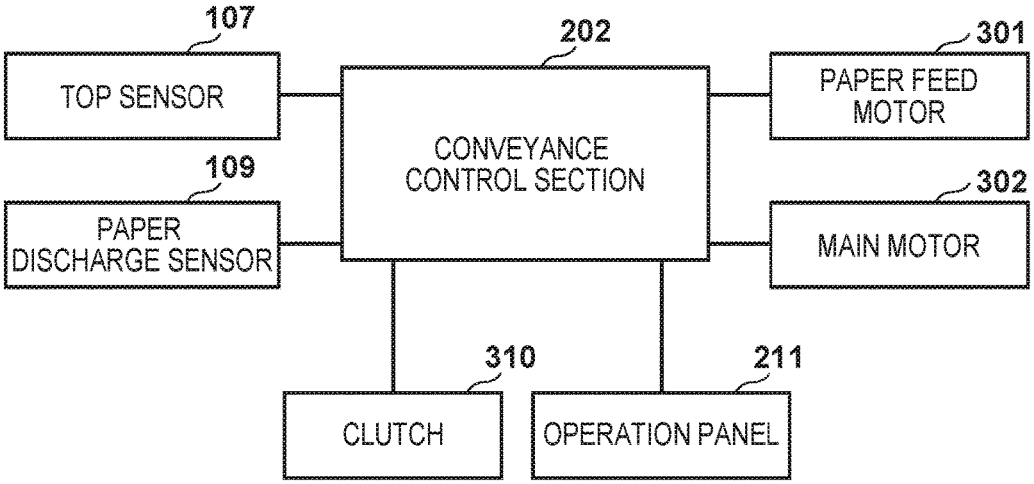
FIG. 3 is a block diagram showing a control system.

FIG. 3 is a block diagram showing a control system. A conveyance control section 202 has an arithmetic device such as a microprocessor, an ASIC (application specific integrated circuit), or an FPGA (field programmable gate array), and storage devices such as a RAM and a ROM. The conveyance control section 202 detects and measures the length of the sheet S and the sheet interval in the conveyance direction, using the top sensor 107 and the paper discharge sensor 109. The conveyance control section 202 controls the paper feed motor 301 based on the measurement value of the sheet interval, temporarily changes the sheet conveyance speed, and thus the sheet interval is controlled to be the target interval. Also, the conveyance control section 202 utilizes the timing at which the top sensor 107 detects the leading end of the sheet S as the start timing of image formation. The conveyance control section 202 detects a jam based on the result of detection by the paper discharge sensor 109. For example, the conveyance control section 202 decides that a jam has occurred if the paper discharge sensor 109 cannot detect the leading end of the sheet S upon a predetermined period of time elapsing after the top sensor 107 has detected the leading end of the sheet S. In particular, the conveyance control section 202 decides that a jam has occurred in the fixing device 130 if the paper discharge sensor 109 cannot detect the trailing end of the sheet S upon a predetermined period of time elapsing after the paper discharge sensor 109 has detected the leading end of the sheet S. The conveyance control section 202 controls the main motor 302 and the paper feed clutch 310 as appropriate. The conveyance control section 202 specifies the sheet size based on information that is input by an operator via an operation panel 211.

In particular, the conveyance control section 202 determines a reduction amount Q by which the interval from the trailing end of the preceding sheet to the leading end of the succeeding sheet is to be reduced, according to the difference between the sheet interval from the trailing end of the preceding sheet to the leading end of the succeeding sheet, which is measured based on the result of detection by the top sensor 107, and the target interval. Furthermore, the conveyance control section 202 corrects the reduction amount Q and allows the paper discharge sensor 109 to detect the trailing end of the preceding sheet and the leading end of the succeeding sheet. Note that the reduction amount Q is corrected according to an error in the measurement value of the length of the preceding sheet in the conveyance direction, which has been measured based on the result of detection by the top sensor 107. Note that this error is an error relative to the nominal value (reference value) of the length of the preceding sheet in the conveyance direction. The conveyance control section 202 controls the paper feed motor 301 so that the conveyance speeds of the conveyance roller 104 and the registration roller 106 are temporarily increased during a period of time corresponding to the reduction amount Q.

Sheet Sensor

Figure 4A:
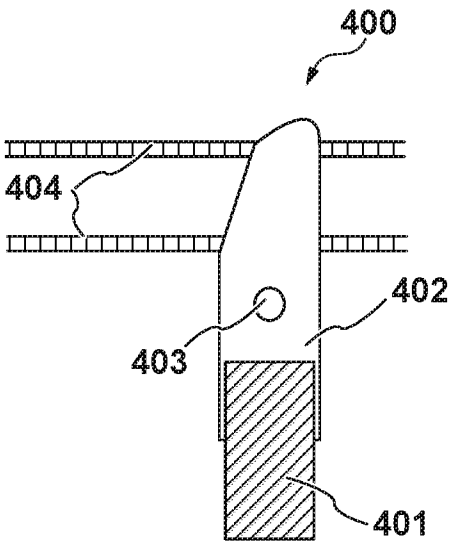
FIGS. 4A to 4F are diagrams illustrating a configuration and actions of a sheet sensor.
Figure 4B:
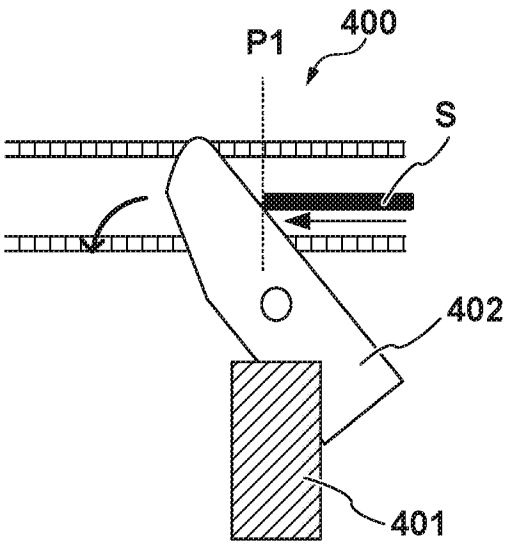
Figure 4C:
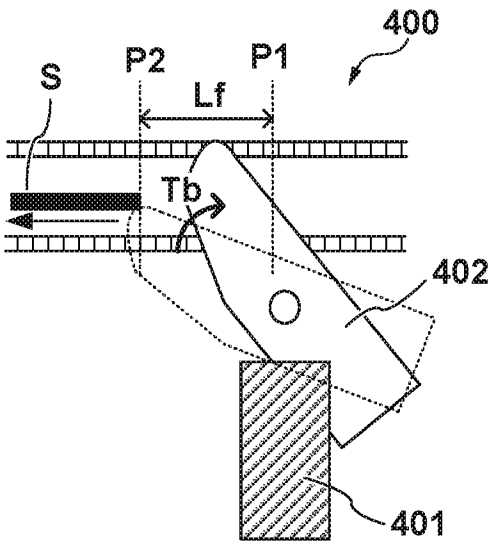
Figure 4D:
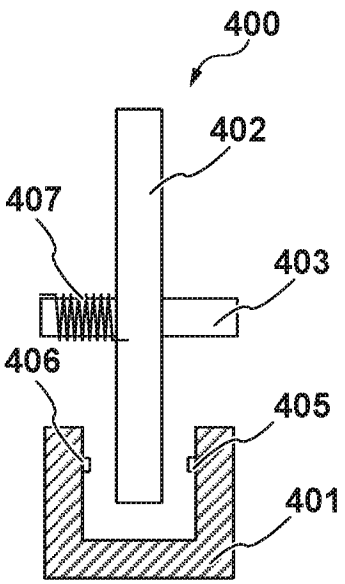

FIG. 4A to FIG. 4F are diagrams illustrating a configuration and actions of a sheet sensor 400 that represents the top sensor 107 and the paper discharge sensor 109. The sheet sensor 400 has: a flag 402 that rotates about a rotation shaft 403 by being pressed by the sheet S; a photointerrupter 401 that switches between a light transmitting state and a light blocking state in response to the rotation of the flag 402; and a spring 407 for returning the flag 402 to a predetermined position. Note that, as shown in FIG. 4D, the photointerrupter 401 has a light emitting element 405 and a light receiving element 406. The state in which the flag 402 is located between the light emitting element 405 and the light receiving element 406 is the light blocking state, and the state in which the flag 402 is not located between the light emitting element 405 and the light receiving element 406 is the light transmitting state.

Next, a description is given of how to obtain the sheet interval using the sheet sensor 400. The sheet S is conveyed from upstream (on the right side) to downstream (on the left side) along a conveyance guide 404. FIG. 4A shows the home position of the flag 402. During a period of time in which the sheet S is not relevant to the flag 402, the flag 402 stops at the home position due to the force of the spring 407. During a period of time in which the flag 402 is stopped at the home position, the flag 402 blocks light that travels from the light emitting element 405 to the light receiving element 406. As shown in FIG. 4B, upon the sheet S reaching the sheet sensor 400, the leading end of the sheet S presses the flag 402, and consequently the flag 402 rotates about the rotation shaft 403. As a result, the photointerrupter 401 changes from the light blocking state to the light transmitting state. The conveyance control section 202 receives a detection signal that the light receiving element 406 outputs upon receiving light from the light emitting element 405, and the conveyance control section 202 thereby recognizes that the leading end of the sheet S has reached an end detection position P1. In this way, upon the leading end of the sheet S reaching the end detection position Pl, the light receiving element 406 of the photointerrupter 401 outputs the detection signal. Note that the rotation angle of the flag 402 when the leading end of the sheet S reaches the end detection position P1 is denoted as θ1. As shown in FIG. 4C, the sheet S is conveyed further downstream, and ultimately the trailing end of the sheet S moves past the flag 402. Upon the trailing end of the sheet S having moved past a separation position P2, the spring 407 starts returning the flag 402 to the home position. The rotation angle of the flag 402 when the trailing end of the sheet S moves past the separation position P2 is denoted as θ2. Upon a time period Tb elapsing since the flag 402 started returning, the flag 402 moves past the end detection position P1 (the rotation angle returns to θ1), and the photointerrupter 401 changes from the light transmitting state to the light blocking state. The conveyance control section 202 recognizes the trailing end of the sheet S upon the detection signal from the light receiving element 406 stopping.

The conveyance speed of the sheet S is equal to the circumferential speed vps, and therefore the conveyance speed of the sheet S is also denoted as vps. The distance from the end detection position P1 to the separation position P2 is denoted as Lf. The photointerrupter 401 maintains the light blocking state during a light blocking time period Tx that is from when the trailing end of the preceding sheet is detected to when the leading end of the succeeding sheet is detected. Therefore, the conveyance control section 202 can determine the sheet interval Lintrvl by using the following formula:

$$\text{Lintrvl}=(Tx+Tb)*vps+Lf \qquad \text{Eq. 1}$$

The distance obtained by multiplying the light blocking time period Tx by the conveyance speed vps is the basis of the sheet interval Lintrvl. Regarding this distance, however, as shown in FIG. 4A to FIG. 4C, the time lag of the photointerrupter 401 needs to be taken into consideration. When the leading end of the succeeding sheet reaches the end detection position P1, the trailing end of the preceding sheet has moved downstream from the end detection position P1 by the distance Lf as well as the distance obtained by multiplying the return time period Tb by the conveyance speed vps. Eq. 1 is true for this reason.

Figure 4E:
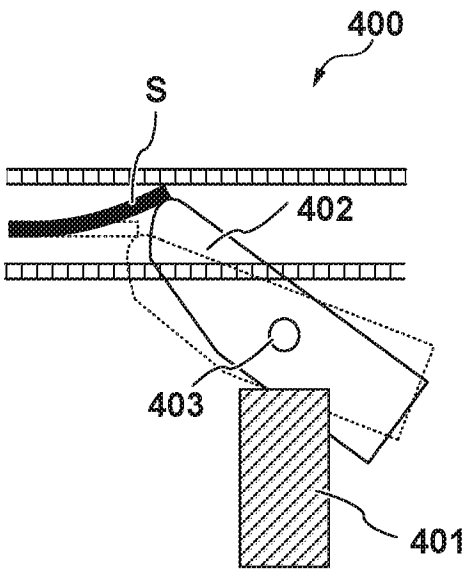
Figure 4F:
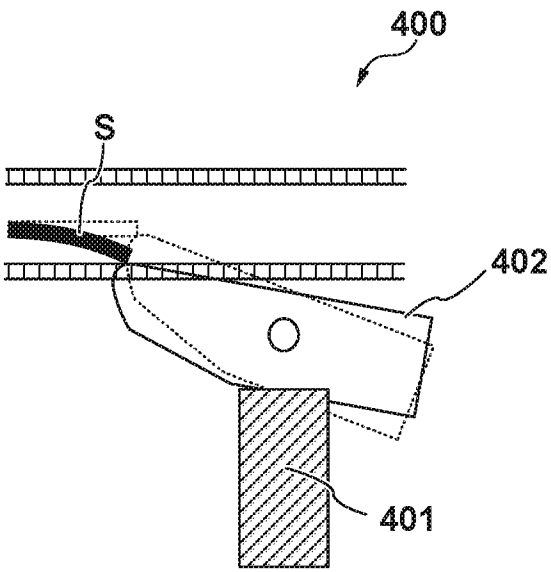

Here, the distance Lf and the return time period Tb of the flag 402 are measured by experiments or simulations at the time of factory shipment, and are stored in the ROM that is built into the conveyance control section 202, or the like. However, as shown in FIG. 4E and FIG. 4F, the separation position P2 in reality varies depending on the elasticity and the curl of the sheet S. The spring constant of the spring 407 also has individual variability. Therefore, there are cases in which the distance Lf and the return time period Tb are different from the design values. In such cases, there is a difference between an actual sheet interval Lact, and the sheet interval Lintrvl obtained from Eq. 1. If the sheet interval Lintrvl obtained from Eq. 1 is longer than the actual sheet interval Lact, the sheet interval reduction amount becomes too large. The sheet interval has a lower limit value that can be detected by the sheet sensor 400. In other words, if the actual sheet interval Lact is shorter than a lower limit interval Lmin_intrvl, the sheet sensor 400 cannot detect the trailing end of the preceding sheet and the leading end of the succeeding sheet. The conveyance control section 202 cannot detect the trailing end of the preceding sheet even upon a predetermined period of time elapsing since the detection of the leading end of the preceding sheet, and thus mistakenly decides that the preceding sheet has jammed. Although there is no jam in reality, the conveyance control section 202 mistakenly detects a jam and stops the image forming operations, and displays a jam message on the operation panel 211. This degrades the usability. On the other hand, if the calculated sheet interval Lintrvl is shorter than the actual interval, the actual sheet interval Lact exceeds the target interval Lt. In other words, the throughput decreases. In light of the problems above, the following improvements may be applied.

Sheet Interval Adjustment

The following describes sheet interval adjustment by acceleration of the paper feed motor 301 (hereinafter referred to as acceleration control) during successive printing. The conveyance control section 202 obtains a sheet presence distance L1 by counting the number of steps of the paper feed motor 301 from the sheet leading end detection to the sheet trailing end detection by the top sensor 107. In other words, the conveyance control section 202 continuously counts the number of steps of the paper feed motor 301 while the light receiving element 406 of the photointerrupter 401 outputs the detection signal. Furthermore, the conveyance control section 202 obtains a sheet absence distance L2 by counting the number of steps from the preceding sheet trailing end detection to the succeeding sheet leading end detection. In other words, the conveyance control section 202 continuously counts the number of steps of the paper feed motor 301 even while the light receiving element 406 of the photointerrupter 401 has stopped outputting the detection signal. As shown in FIG. 4C, the distance from the end detection position P1 of the top sensor 107 to the separation position P2 is denoted as Lf. Also, the return time period during which the flag 402 returns from the separation position P2 to the end detection position P1 is denote as Tb. The measurement result Lmsr of the sheet length of the preceding sheet and the sheet interval Lintrvl between the preceding sheet and the succeeding sheet are expressed using these parameters.

$$\text{Lmsr}=L1-Lf-Tb*vps \quad \text{Eq. 2}$$

$$\text{Lintrvl}=L2+Lf+Tb*vps \quad \text{Eq. 3}$$

The sheet presence distance L1 includes the distance by which the leading end of the sheet S proceeds during the period of time from when the leading end of the sheet S reaches the end detection position P1 to when the flag 402 returns to the end detection position P1. In other words, the sheet presence distance L1 includes a distance "Tb*vps" by which the leading end proceeds during the return time period Tb, in addition to the distance Lf from the end detection position P1 to the separation position P2. Therefore, the measurement result Lmsr of the length of the sheet S can be obtained by subtracting the distance Lf and "Tb*vps" from the sheet presence distance L1. Eq. 3 can be obtained from Eq. 1. Specifically, the sheet absence distance L2 is equivalent to the distance by which the trailing end of the preceding sheet proceeds during the light blocking time period Tx.

Note that the distance Lf and the return time period Tb are values that are obtained at the time of factory shipment, by experiments or simulations in which typical sheets are conveyed. As described above, there are errors between these values and actual values. Therefore, in order to more precisely adjust the sheet interval, it is necessary to take these errors into consideration.

The paper discharge sensor 109, as well as the top sensor 107, is realized using the sheet sensor 400. The following describes how to obtain a lower limit interval Lmin_intrvl that can be detected by the paper discharge sensor 109. Regarding the lower limit interval Lmin_intrvl, a noise control time period Tc may be taken into consideration in addition to the distance Lf and the return time period Tb. The noise control time period Tc is the period of time from when the photointerrupter 401 of the paper discharge sensor 109 comes into a sheet absence state to when the conveyance control section 202 confirms the sheet absence. Therefore, the lower limit interval Lmin_intrvl can be obtained by Eq. 4.

$$\text{Lmin_intrvl}=Lf+(Tb+Tc)*vps \quad \text{Eq. 4}$$

Here, the distance Lf and the return time period Tb are values that maximize the lower limit interval Lmin_intrvl, out of values that are determined based on combinations of the mechanical tolerances of the paper discharge sensor 109 and the type of the sheet S. These values are determined by experiments or simulations at the time of factory shipment. The lower limit interval Lmin_intrvl that is ultimately obtained is stored in the ROM that is built into the conveyance control section 202.

Method for Determining Reduction Amount

Figure 5:
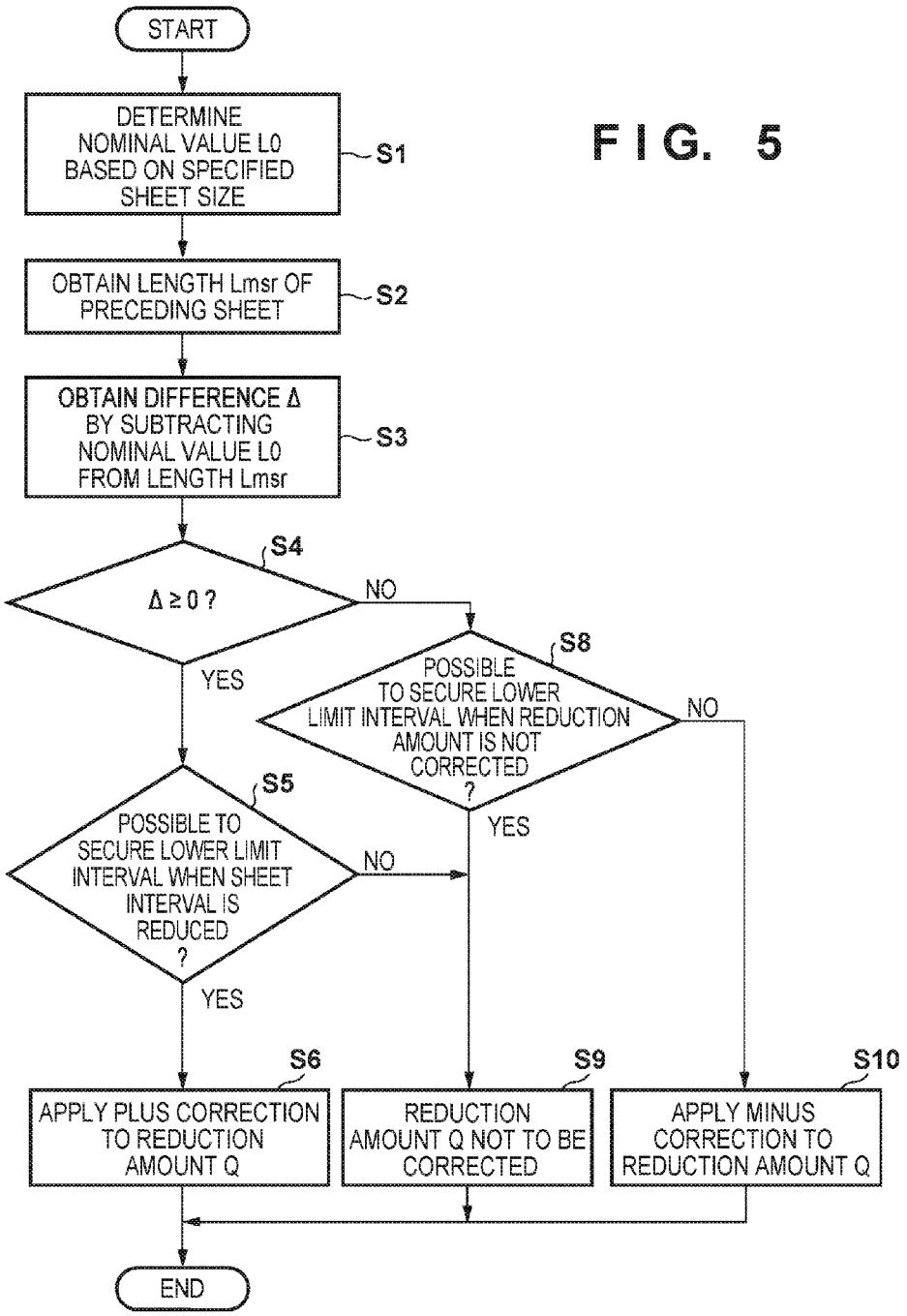
FIG. 5 is a flowchart showing a process in which a reduction amount is determined.

The following describes a method for determining the reduction amount Q that is to be reduced by acceleration control with reference to the flowchart shown in FIG. 5. The reduction amount Q is an amount that is determined according to the error between the measured sheet interval Lintrvl and the target interval Lt, and by which the sheet interval is to be reduced. Upon detecting the leading end of the succeeding sheet using the top sensor 107, the conveyance control section 202 performs the following processes.

In step S1, the conveyance control section 202 determines the length of the preceding sheet in the conveyance direction (hereinafter referred to as a nominal value L0) from the sheet size specified by the operator via the operation panel 211. The conveyance control section 202 has stored nominal values L0 corresponding to sheet sizes (e.g., B5, B5R, A4, A4R, B4, A3, etc.) to the ROM in advance. Here, the nominal value L0 is a reference value or a standardized value of a sheet size. For example, the nominal value L0 of A4 sheets is 297 mm, and the nominal value L0 of A3 sheets is 420 mm. Thus, the conveyance control section 202 reads the nominal value L0 corresponding to the specified size from the ROM.

In step S2, the conveyance control section 202 obtains the measurement result Lmsr of the length of the preceding sheet from the RAM. It is assumed that the conveyance control section 202 has obtained the measurement result Lmsr of the length of the preceding sheet using Eq. 2, and has stored the measurement result Lmsr in advance in the RAM that is built into the conveyance control section 202.

In step S3, the conveyance control section 202 obtains a difference Δ in the length by subtracting the nominal value L0 from the measurement result Lmsr.

In step S4, the conveyance control section 202 decides whether or not the difference Δ is greater than or equal to 0, that is to say, whether or not the measurement result Lmsr is greater than or equal to the nominal value L0. If the difference Δ is greater than or equal to 0, the measurement result Lmsr is greater than or equal to the nominal value L0, and the conveyance control section 202 proceeds to step S5. On the other hand, if the difference Δ is smaller than 0, the measurement result Lmsr is smaller than the nominal value L0, and the conveyance control section 202 proceeds to step S8.

There are two cases in which the measurement result Lmsr is greater than or equal to the nominal value L0. The first case is the case where the sheet length is actually longer than the nominal value L0. The second case is the case shown in FIG. 4F. This is the case where, although the nominal value L0 and the sheet length are the same, the action of the sheet S assumed in Eq. 2 does not match the actual action. In the former case, the succeeding sheet only needs to be accelerated by an amount corresponding to the difference between the target interval Lt and the sheet interval measurement result Lintrvl. However, in the latter case, the calculated sheet interval measurement result Lintrvl is shorter by the error included in the measurement result Lmsr of the length of the sheet S. Therefore, even if the succeeding sheet is accelerated by an amount corresponding to the difference between the target interval Lt and the sheet interval measurement result Lintrvl, the sheet interval becomes greater than the target by Δ, and the throughput decreases. In light of the problem above, it is possible to appropriately maintain the throughput by applying a plus Δ correction to the reduction amount Q. However, if a plus Δ correction is similarly applied to the reduction amount Q in the former case, the sheet interval becomes too narrow, and there is the possibility of the paper discharge sensor 109 being unable to detect the sheet interval. In other words, jam misdetection or the like might occur. In the present embodiment, in light of the problem above, whether or not the paper discharge sensor 109 can detect the sheet interval is taken into consideration when a plus correction is applied to the reduction amount Q (i.e., when the sheet interval reduction amount is increased).

In step S5, the conveyance control section 202 decides whether or not the paper discharge sensor 109 can detect the sheet interval when a plus correction is applied to the reduction amount Q (i.e., when the sheet interval reduction amount is increased). For example, the conveyance control section 202 may decide whether or not "target interval Lt−difference Δ" is greater than or equal to the lower limit interval Lmin_intrvl that can be detected by the paper discharge sensor 109. If the paper discharge sensor 109 can detect the sheet interval even if a plus correction is applied to the reduction amount Q, step S6 is performed next.

In step S6, the conveyance control section 202 applies a plus correction to the reduction amount Q. For example, the conveyance control section 202 determines the reduction amount Q by subtracting the target interval Lt from the sheet interval measurement result Lintrvl, and corrects the reduction amount Q by adding the difference Δ to the reduction amount Q.

On the other hand, in the case where it has been determined in step S5 that the paper discharge sensor 109 becomes unable to detect the sheet interval if a plus correction is applied to the reduction amount Q, the conveyance control section 202 proceeds to step S9. The conveyance control section 202 does not use the difference Δ to correct the reduction amount Q. That is to say, the conveyance control section 202 determines the reduction amount Q by subtracting the target interval Lt from the sheet interval measurement result Lintrvl.

In step S4, if the difference Δ is smaller than 0, the measurement result Lmsr is smaller than the nominal value L0, and the conveyance control section 202 proceeds to step S8. There are also two cases in which the measurement result Lmsr is smaller than the nominal value L0. The first case is the case where the sheet length is actually shorter than the nominal value L0. The second case is the case where, although the nominal value L0 and the sheet length are the same, Eq. 2 does not match the actual action of the sheet as shown in FIG. 4E. In the former case, the succeeding sheet only needs to be accelerated by an amount corresponding to the difference between the target interval Lt and the sheet interval measurement result Lintrvl. However, in the latter case, the calculated sheet interval measurement result Lintrvl is longer by the error in the sheet length. Therefore, if the succeeding sheet is accelerated by the amount corresponding to the difference between the target interval Lt and the sheet interval measurement result Lintrvl, the sheet interval becomes too narrow, and the paper discharge sensor 109 becomes unable to detect the sheet interval. In other words, jam misdetection or the like might occur. For this reason, whether or not the paper discharge sensor 109 can detect the sheet interval when the reduction amount Q is not corrected according to the difference Δ, is taken into consideration.

In step S8, the conveyance control section 202 decides whether or not the paper discharge sensor 109 can detect the sheet interval when the reduction amount Q is not corrected according to the difference Δ. For example, the conveyance control section 202 decides whether or not the value obtained by subtracting −Δ from the target interval Lt is greater than or equal to the lower limit interval Lmin_intrvl. Note that a decision has been made in step S4 that Δ is a negative value, and therefore −Δ is a positive value. If the paper discharge sensor 109 can detect the sheet interval when the reduction amount Q is not corrected according to the difference Δ, the conveyance control section 202 proceeds to step S9.

In step S9, the conveyance control section 202 does not use the difference Δ to correct the reduction amount Q. That is to say, the conveyance control section 202 determines the reduction amount Q by subtracting the target interval Lt from the sheet interval measurement result Lintrvl.

On the other hand, in the case where there is the risk of the paper discharge sensor 109 becoming unable to detect the sheet interval if the reduction amount Q is not corrected according to the difference Δ, the conveyance control section 202 proceeds to step S10.

In step S10, the conveyance control section 202 applies a minus correction to the reduction amount Q. For example, the conveyance control section 202 determines the reduction amount Q by subtracting the target interval Lt and −Δ from the sheet interval measurement result Lintrvl.

Acceleration Control

Figure 6:
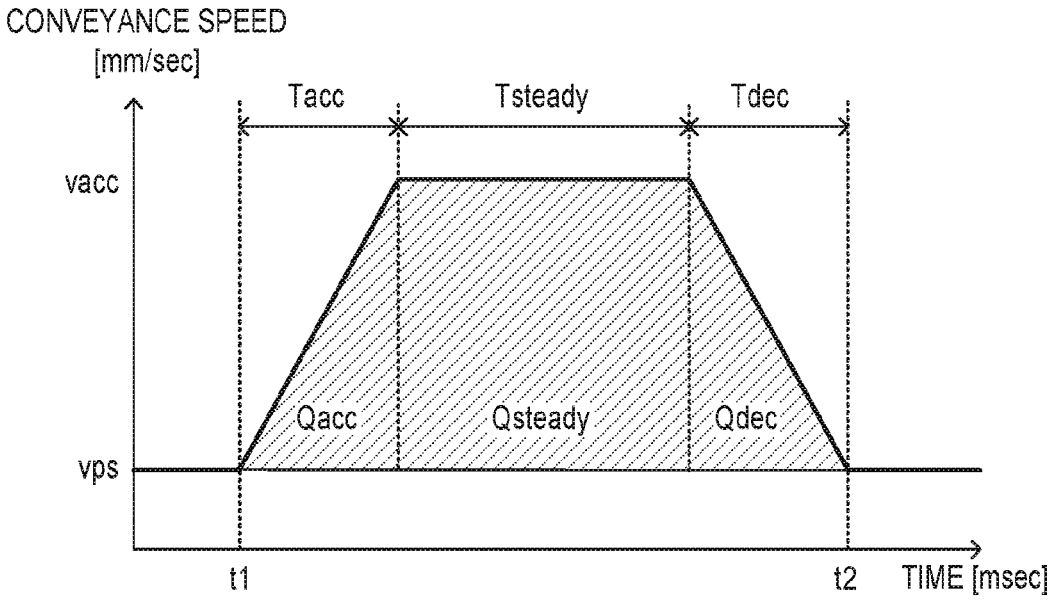
FIG. 6 is a diagram illustrating a conveyance speed and a conveyance time period.

The following describes acceleration control with reference to FIG. 6. In the present embodiment, the conveyance control section 202, when performing acceleration control, accelerates the conveyance speed of the sheet S from vps to vacc by accelerating the rotation speed of the paper feed motor 301. As shown in FIG. 6, an acceleration time period that is needed for the acceleration from vps to vacc is denoted as Tacc (msec). A deceleration time period that is needed for the deceleration from vacc to vps is denoted as Tdec (msec). The reduction amount during the acceleration time period is denoted as Qacc (mm), and the reduction amount during the deceleration time period is denoted as Qdec (mm). These values are determined based on a speed-up table or a slow-down table for the paper feed motor 301, stored in the ROM. In order to simplify the description, the case where the reduction amount Q is greater than "Qacc+Qdec" is taken as an example. In order to obtain a desired reduction amount Q by performing acceleration control, the sheet interval needs to be reduced by "Q−Qacc−Qdec" (mm) after the speed vacc is reached. This amount is denoted as Qsteady. The conveyance control section 202 obtains a conveyance time period Tsteady (msec) corresponding to the speed vacc by the following equation:

$$Tsteady=(Q-Qacc-Qdec)/(vacc-vps) \quad \text{Eq. 5}$$

As described above, the reduction amount Q for the second sheet and the subsequent sheets in the successive printing is determined at the time the top sensor 107 detects the leading end of the corresponding sheet. Then, the conveyance control section 202 determines the acceleration time period Tsteady based on the reduction amount Q. The conveyance control section 202 starts accelerating the paper feed motor 301 at time t1, and starts decelerating the paper feed motor 301 when "Tacc+Tsteady" (msec) has elapsed since the time t1. Consequently, the conveyance speed returns from vacc to vps.

Although FIG. 6 illustrates acceleration control, the case where the sheet interval is increased by deceleration control is similar. By performing acceleration control in this way, it is possible to prevent the paper discharge sensor 109 from being unable to detect the sheet interval due to the measurement error of the top sensor 107, and it is possible to maintain the throughput.

Embodiment 2

In Embodiment 1, the method for determining the reduction amount Q is selected by using the difference Δ between the sheet length measurement result Lmsr of the preceding sheet and the nominal value specified by the operator. Embodiment 1 is based on the premise that the operator specifies the correct size of the sheet S. Therefore, if the operator specifies an incorrect size, the reduction amount Q cannot be correctly determined. In light of the problem above, Embodiment 2 describes an example in which the reduction amount is determined based on the range of measurement error that has been measured in advance. Note that the description of matters that Embodiment 2 have in common with Embodiment 1 is omitted.

As described with reference to FIG. 4A to FIG. 4F, the top sensor 107 has the flag 402, the photointerrupter 401, the spring 407, and so on. Therefore, there are the following factors that might cause a sheet interval measurement error:

- the tolerance of the shape of the flag 402;
- the attachment tolerance of the flag 402 and the photointerrupter 401;
- the tolerance of the spring constant of the spring 407; and
- whether the leading end of the sheet S and the trailing end of the sheet S pass through the upper side of the conveyance path (FIG. 4E) or the lower side of the conveyance path (FIG. 4F).

The range of a potential sheet interval measurement error can be found by performing experiments with different combinations of these factors. It is assumed that the measurement result of a sheet length Lp varies within the range of "Lp−ΔLmin" to "Lp+ΔLmax". A difference ΔL between the lower limit value and the upper limit value of the sheet length Lp of one sheet is "ΔLmin+ΔLmax". Therefore, the range of a potential measurement error in the sheet length measurement result Lmsr is from −ΔLmax to +ΔLmin.

Figure 7:
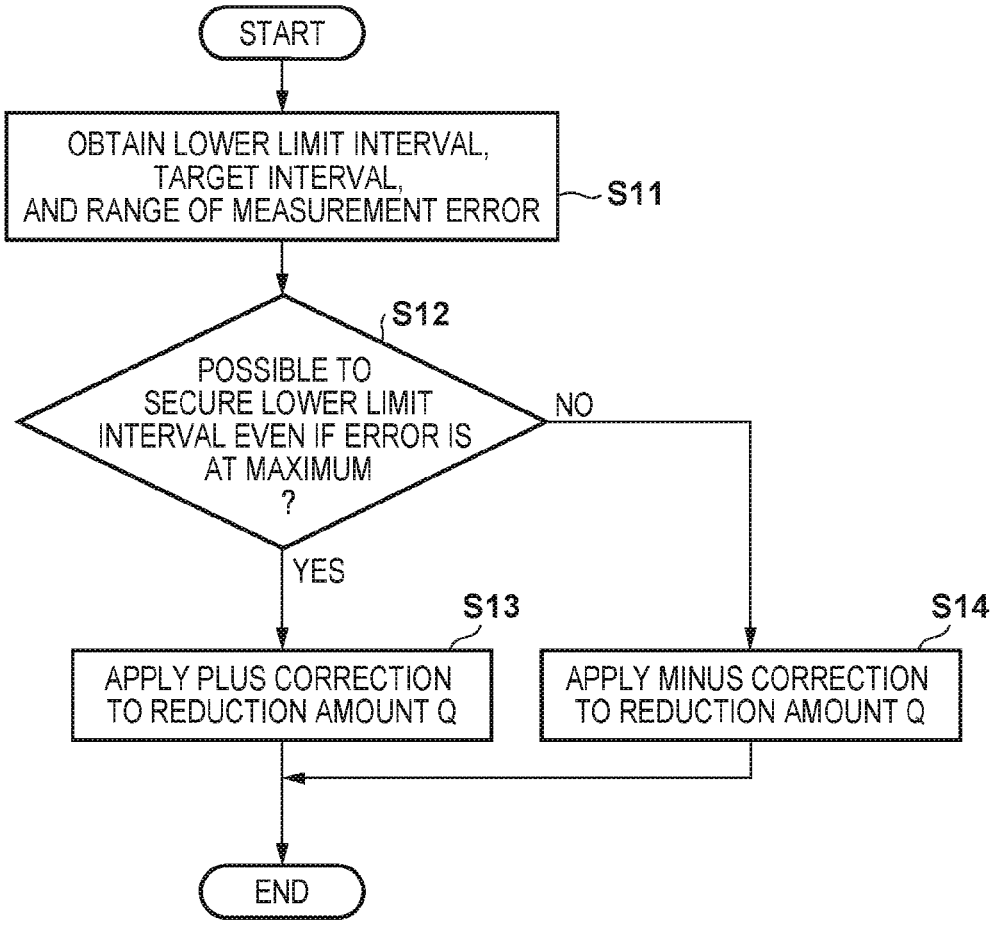
FIG. 7 is a flowchart showing a process in which a reduction amount is determined.

FIG. 7 is a flowchart showing a process according to Embodiment 2, in which the sheet interval adjustment amount (the reduction amount Q) is determined.

In step S11, the conveyance control section 202 obtains the lower limit interval Lmin_intrvl, the target interval Lt, and ΔLmax and ΔLmin that define the range of a potential measurement error. For example, the conveyance control section 202 reads out these parameters from the ROM. Alternatively, the conveyance control section 202 may calculate the target interval Lt based on the throughput.

In step S12, the conveyance control section 202 decides whether or not it is possible to secure the lower limit interval Lmin_intrvl when the measurement error is at the maximum. The initial value of the reduction amount Q is the difference between the sheet interval measurement result Lintrvl and the target interval Lt. The sheet interval measurement error is within the range of −ΔLmin to +αLmax because the sheet interval measurement error includes a component that is the same as the sheet length measurement error. When the error component is at the maximum, the sheet interval after correction is "target interval Lt−ΔLmin". If this value is greater than or equal to the lower limit interval Lmin_intrvl, it is possible to secure the sheet interval that is greater than or equal to the lower limit interval Lmin_intrvl even when the error is at the maximum. For this reason, the conveyance control section 202 may decide whether or not "target interval Lt−ΔLmin" is greater than or equal to the lower limit interval Lmin_intrvl. If "target interval Lt−ΔLmin" is greater than or equal to the lower limit interval Lmin_intrvl, it is possible to secure the lower limit interval Lmin_intrvl even if the sheet interval is reduced by further accelerating the succeeding sheet by ΔL, and therefore the conveyance control section 202 proceeds to step S13.

In step S13, the conveyance control section 202 applies a plus correction to the reduction amount Q. For example, the conveyance control section 202 may obtain the reduction amount Q by subtracting the target interval Lt from the sheet interval measurement result Lintrvl, and also adding ΔLmax thereto.

On the other hand, in the case where a decision is made that it is impossible to secure the lower limit interval Lmin_intrvl when the measurement error is at the maximum, the conveyance control section 202 proceeds to step S14. In step S14, the conveyance control section 202 applies a minus correction to the reduction amount Q. For example, the conveyance control section 202 determines the reduction amount Q by subtracting the target interval Lt from the sheet interval measurement result Lintrvl, and corrects the reduction amount Q by subtracting ΔLmin from the reduction amount Q.

Correcting the reduction amount Q in such a manner makes it possible to appropriately correct the reduction amount Q. Note that ΔLmin and ΔLmax are experimentally obtained with consideration to where in the conveyance path the sheet S passes. However, ΔLmin and ΔLmax vary depending on the type of the sheet (the basis weight, the presence or absence of coating, etc.). ΔLmin and ΔLmax that are independent of the type may be obtained and stored in the ROM by using various kinds of sheets in the experiments. Alternatively, ΔLmin and ΔLmax of each type of sheet S may be obtained and stored in the ROM by performing experiments for each type of sheet S. If this is the case, the conveyance control section 202 may read out ΔLmin and ΔLmax that correspond to the type specified by the operator via the operation panel 211, from the ROM, and obtain ΔL by addition of ΔLmin and ΔLmax.

In this way, in Embodiment 2, the range of a potential measurement error is obtained at the time of factory shipment, and the reduction amount Q is determined according to this range. Therefore, it is possible to prevent the paper discharge sensor 109 from being unable to detect the sheet interval due to the measurement error of the top sensor 107, and it is possible to maintain the throughput.

Embodiment 3

In Embodiments 1 and 2, the sheet sensor 400 that has the photointerrupter 401 and the flag 402 is described as the top sensor 107. However, the present invention may employ another type of sheet sensor. A rotational sheet sensor is described in Embodiment 3. Note that the description of matters that Embodiment 3 have in common with Embodiments 1 and 2 is omitted.

FIG. 8A to FIG. 8F are diagrams illustrating the configuration and the actions of a rotational sheet sensor 400'. The sheet sensor 400' has: a shaft 904 that serves as the rotation center; a flag 902 for detecting the sheet S; a photointerrupter flag 903; and a photointerrupter 901. The flag 902 and the flag 903 are fixed to the shaft 904 and rotate together. It is assumed that the sheet S is conveyed from right to left along the conveyance guide 404.

Figure 8A:
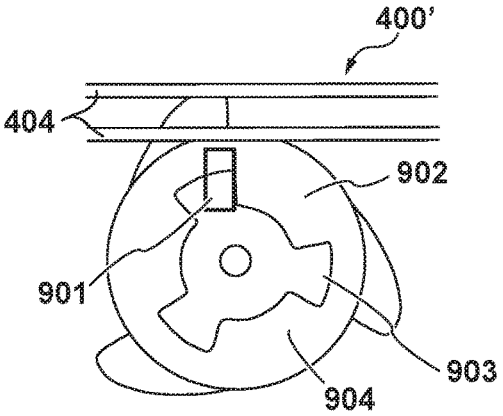
FIGS. 8A to 8F are diagrams illustrating a configuration and actions of a sheet sensor.

FIG. 8A shows the sheet sensor 400' in the state where the sheet S has not been fed. In FIG. 8A, the flag 902 is located at the home position. In the state where the sheet S has not been fed, a cam mechanism and a power source such as a spring thus return the flag 902 to the home position. The photointerrupter 901 is maintained in the light blocking state by the flag 903 while the flag 902 is being located at the home position.

Figure 8B:
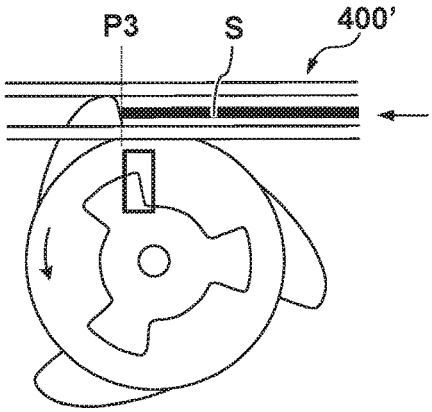

As shown in FIG. 8B, upon the sheet S reaching the sheet sensor 400', the leading end of the sheet S presses the flag 902, and consequently the shaft 904 rotates in the counter clockwise direction. Upon the leading end of the sheet S reaching a leading end detection position P3, the photointerrupter 901 changes from the light blocking state to the light transmitting state. Consequently, the conveyance control section 202 can detect the leading end of the sheet S. Upon the sheet S being further conveyed, the leading end of the sheet S releases the engagement with a protruding portion of the flag 902.

Figure 8C:
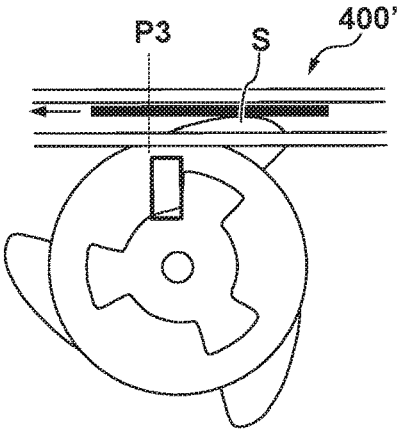

Consequently, as shown in FIG. 8C, the central portion of the sheet S engages with the protruding portion. At this stage, although the circumferential speed of the protruding portion is smaller than the conveyance speed of the sheet S, the flag 902 is rotated in the counter clockwise direction due to the presence of a cam mechanism, which is not shown in the drawings. Note that the flag 902 is provided with three protruding portions arranged every 120 degrees. Due to the action of the cam, the flag 902 rotates by 120 degrees each time one sheet S moves past the sheet sensor 400'.

Figure 8D:
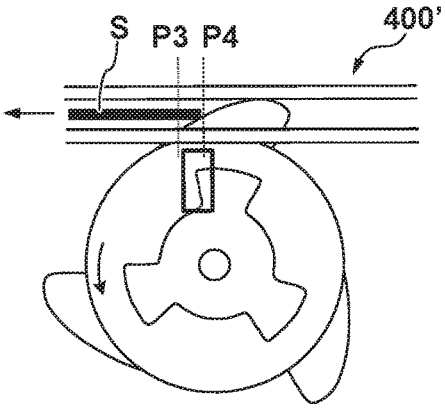

As shown in FIG. 8D, the photointerrupter 901 changes from the light transmitting state to the light blocking state at the time the trailing end of the sheet S reaches a trailing end detection position P4. Consequently, the conveyance control section 202 can detect the trailing end of the sheet S.

Figure 8E:
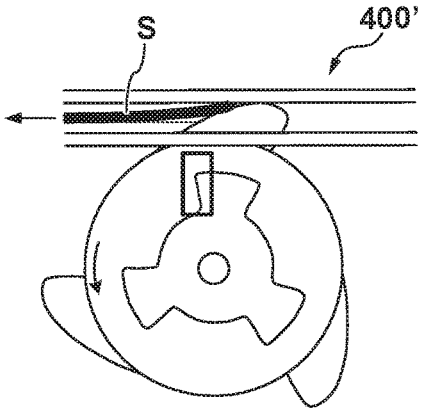
Figure 8F:
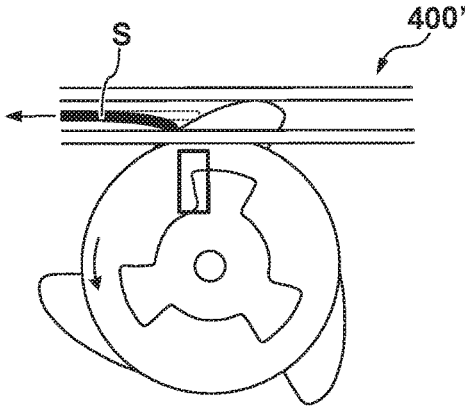

In Embodiment 1, an error occurs in the measurement result of the sheet interval Lintrvl depending on the return time period Tb of the flag 402 of the top sensor 107 in addition to the distance Lf between the end detection position P1 and the separation position P2. In contrast, in the case of the rotational sheet sensor 400', the orientation of the sheet S depending on the elasticity and the curl of the sheet S is the main factor of the error as shown in FIG. 8E and FIG. 8F.

Figure 9:
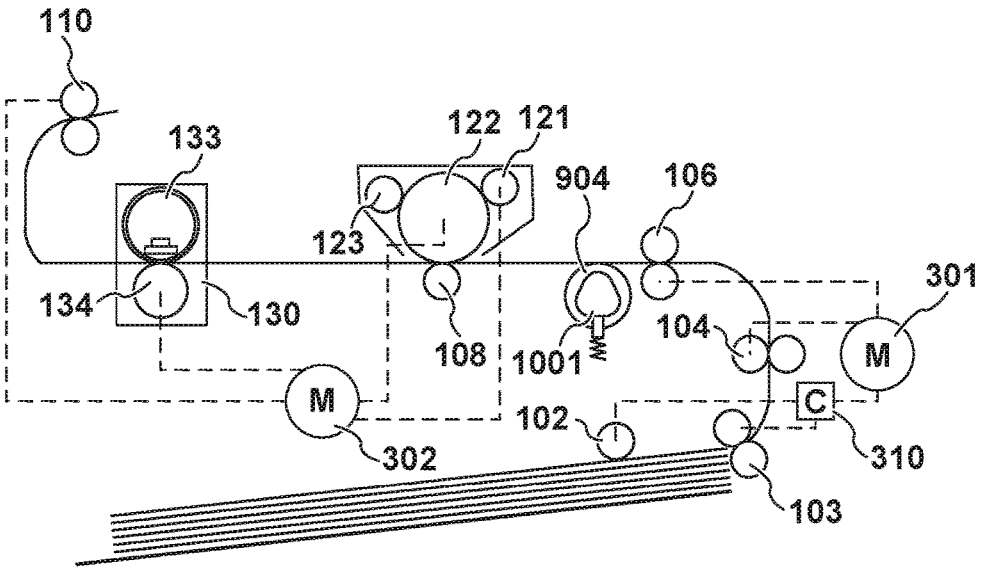
FIG. 9 is a diagram showing a relationship between rollers and motors.

FIG. 9 shows the relationship between the rollers in the image forming apparatus 100 according to Embodiment 3 and the motors that drive the rollers. A cam 1001 rotates the shaft 904 of the sheet sensor 400' 120 degrees each time.

In Embodiment 3, Eq. 6 and Eq. 7 are adopted instead of Eq. 2 and Eq. 3 described in Embodiment 1.

$$\text{Lmsr}=L1+Lf' \quad \text{Eq. 6}$$

$$\text{Lintrvl}=L2-Lf' \quad \text{Eq. 7}$$

Here, as shown in FIG. 8D, Lf' denotes the distance from the leading end detection position P3 to the trailing end detection position P4. Lf' is obtained by performing experiments at the time of factory shipment, in which typical sheets S are conveyed. Therefore, as described above, Lf' might have an error relative to the actual distance from the leading end detection position P3 to the trailing end detection position P4. Embodiment 3 is the same as Embodiment 1 except that the methods for obtaining the sheet length measurement result Lmsr and the sheet interval measurement result Lintrvl are different. The range of a potential sheet interval measurement error in the case of using the rotational sheet sensor 400' is affected by the following factors:

- the tolerance of the shape of the flag 902;
- the tolerance of the shape of the flag 903;
- the attachment tolerance of the shaft 904;
- the attachment tolerance of the photointerrupter 901; and
- whether the leading end of the sheet S and the trailing end of the sheet S pass through the upper side of the conveyance path (FIG. 8E) or the lower side of the conveyance path (FIG. 8F).

The range of a potential measurement error has been obtained in advance by experiments according to combinations of these factors. Therefore, Embodiment 2 is also applicable to the rotational sheet sensor 400'.

In this way, the ideas of Embodiments 1 and 2 are applicable even if the rotational sheet sensor 400' is adopted as the top sensor 107. That is to say, in Embodiment 3, in the same manner as in Embodiments 1 and 2, it is possible to prevent the paper discharge sensor 109 from being unable to detect the sheet interval due to the measurement error of the top sensor 107, and it is possible to maintain the throughput.

Conclusion

Figure 10:
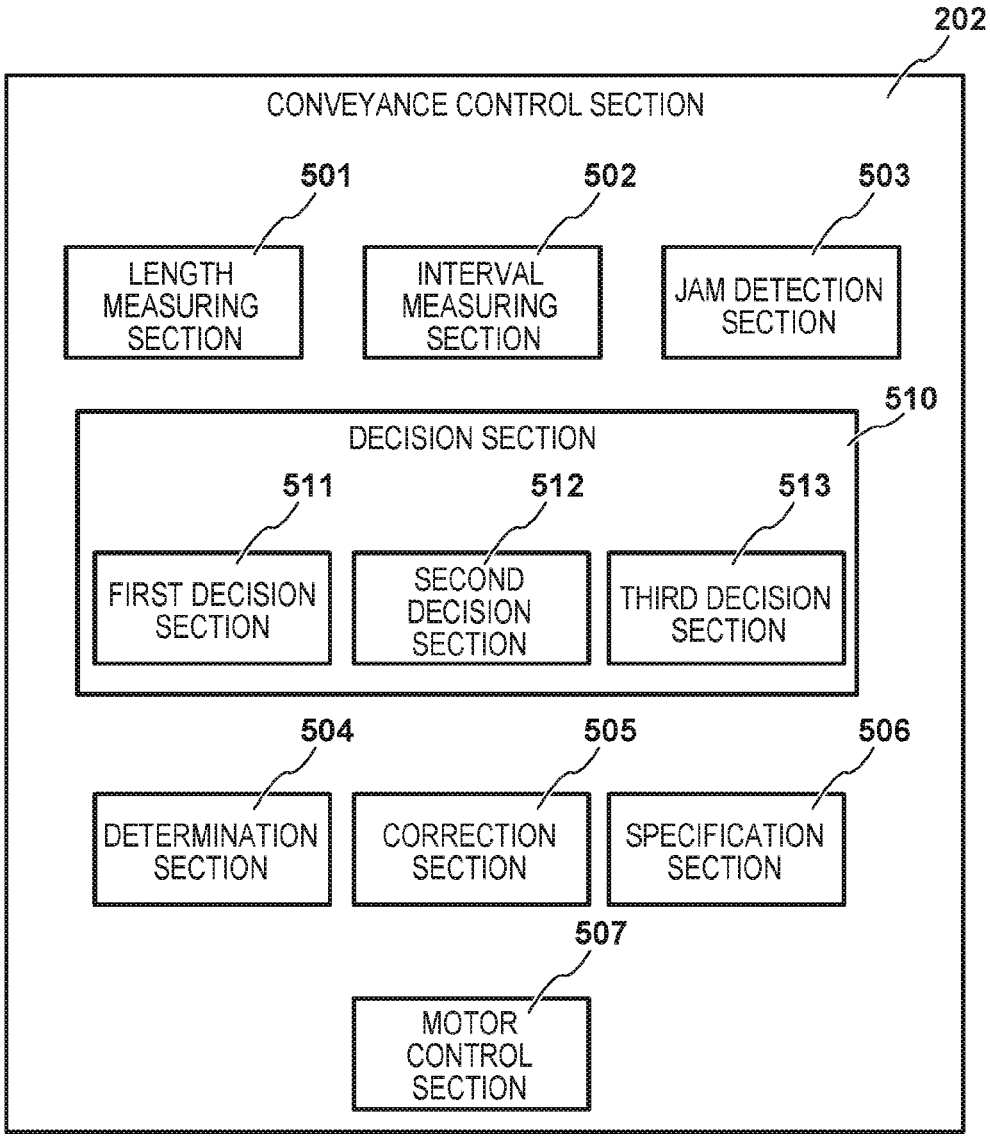
FIG. 10 is a diagram showing functions of a conveyance control section.

The following describes the functions of the conveyance control section 202 related to Embodiments 1 to 3 with reference to FIG. 10. The functions may be realized by a microprocessor executing a program, or realized with hardware such as an ASIC or an FPGA. Alternatively, it is acceptable that some of the functions are realized with software and the remaining functions are realized with hardware. A length measuring section 501 measures the length Lmsr from the leading end to the trailing end of the sheet S based on the result of detection by the top sensor 107. A specification section 506 functions as an obtaining unit that obtains the nominal value L0 of the length of the preceding sheet in the conveyance direction based on the sheet size specified by the operator. An interval measuring section 502 measures the sheet interval Lintrvl from the trailing end of the preceding sheet to the leading end of the succeeding sheet based on the result of detection by the top sensor 107. A jam detection section 503 detects the occurrence of a jam based on the result of detection by the paper discharge sensor 109.

A determination section 504 determines an adjustment amount (e.g., the reduction amount Q) for adjusting the interval from the trailing end of the preceding sheet to the leading end of the succeeding sheet based on a difference d between the sheet interval Lintrvl from the trailing end of the preceding sheet to the leading end of the succeeding sheet measured based on the result of detection by the top sensor 107, and the target interval Lt. A correction section 505 corrects the adjustment amount so as to allow the paper discharge sensor 109 to detect the trailing end of the preceding sheet and the leading end of the succeeding sheet. For example, the correction section 505 corrects the adjustment amount according to the error Δ of the measurement value of the length of the preceding sheet in the conveyance direction measured based on the result of detection by the top sensor 107, relative to the nominal value of the length of the preceding sheet in the conveyance direction. As described with reference to FIG. 6, a motor control section 507 controls the paper feed motor 301 so that the conveyance speeds of the conveyance roller 104 and the registration roller 106 temporarily increase or decrease during a period of time corresponding to the corrected adjustment amount.

Consequently, it becomes possible to more precisely control the sheet interval compared to conventional technology. In other words, it becomes possible to prevent jam misdetection while maintaining the throughput.

As described for step S5, a decision section 510 may decide whether or not the paper discharge sensor 109 can detect the trailing end of the preceding sheet and the leading end of the succeeding sheet even if the sheet interval is reduced, based on the target interval Lt, the error Δ, and the lower limit interval that is a predetermined interval. Here, a decision may be made as to whether or not the difference between the target interval Lt and the error Δ is greater than or equal to the lower limit interval Lmin_intrvl. This decision is equivalent to a decision as to whether or not the value obtained by subtracting the difference d between the sheet interval Lintrvl and the target interval Lt and the error Δ from the sheet interval Lintrvl is greater than or equal to the lower limit interval Lmin_intrvl. The correction section 505 increases, maintains, or reduces the reduction amount Q depending on the result of decision by the decision section 510.

As described for step S4, a first decision section 511 decides whether or not the measurement value Lmsr of the length of the preceding sheet in the conveyance direction measured based on the result of detection by the top sensor 107 is greater than or equal to the nominal value of the length of the preceding sheet in the conveyance direction. As described for step S5, a second decision section 512 may decide whether or not the difference obtained by subtracting the error Δ from the target interval Lt is greater than or equal to the lower limit interval Lmin_intrvl if the measurement value Lmsr is greater than or equal to the nominal value. The correction section 505 increases the reduction amount Q if the measurement value Lmsr is greater than or equal to the nominal value and the difference obtained by subtracting the error Δfrom the target interval Lt is greater than or equal to the lower limit interval Lmin_intrvl. In other words, as described for step S6, the correction section 505 increases the reduction amount Q by the error Δ. Consequently, the throughput improves. On the other hand, the correction section 505 does not correct the reduction amount Q if the measurement value Lmsr is greater than or equal to the nominal value and the difference obtained by subtracting the error Δ from the target interval Lt is not greater than or equal to the predetermined interval. If this is the case, "reduction amount Q=difference d" is true. Consequently, the paper discharge sensor 109 becomes able to detect the sheet interval, and the frequency of jam misdetection decreases.

As described for step S8, if the measurement value Lmsr is not greater than or equal to the nominal value, a third decision section 513 decides whether or not the difference obtained by subtracting the difference Δ between the measurement value and the nominal value from the target interval Lt is smaller than or equal to a predetermined interval. Note that the predetermined interval is the lower limit interval Lmin_intrvl. The correction section 505 does not correct the reduction amount Q if the measurement value Lmsr is not greater than or equal to the nominal value and the difference obtained by subtracting the difference Δbetween the measurement value and the nominal value from the target interval Lt is smaller than or equal to the lower limit interval Lmin_intrvl. Consequently, the paper discharge sensor 109 becomes able to detect the sheet interval, and the frequency of jam misdetection decreases. On the other hand, the correction section 505 reduces the reduction amount Q if the measurement value Lmsr is not greater than or equal to the nominal value and the difference obtained by subtracting the difference Δ between the measurement value and the nominal value from the target interval Lt is not smaller than or equal to the lower limit interval Lmin_intrvl. For example, the correction section 505 may reduce the reduction amount Q by the difference Δ obtained by subtracting the measurement value Lmsr from the nominal value. Consequently the throughput improves.

As described with reference to FIG. 6, the motor control section 507 accelerates the conveyance speed of the conveyance roller 104 and so on from a first conveyance speed vps to a second conveyance speed vacc that is faster than the first conveyance speed vps during a period of time corresponding to the reduction amount Q. The first conveyance speed vps is the speed determined based on the throughput of the image forming apparatus 100. Consequently, the sheet interval is reduced and the throughput improves. For example, the motor control section 507 linearly increases the conveyance speed during a first time period Tacc that starts from time t1 at which the motor control section 507 starts accelerating the conveyance speed. This operation can be easily realized by storing a speed-up table serving as a control table in the ROM. Furthermore, the motor control section 507 maintains the conveyance speed to be a second conveyance speed vass during a second time period Tsteady that starts from the time at which the conveyance speed reaches the second conveyance speed vacc. Furthermore, the motor control section 507 linearly reduces the conveyance speed to the first conveyance speed vps during a third time period Tdec that is subsequent to the second time period. This operation can be easily realized by storing a slow-down table serving as a control table in the ROM.

As described with reference to FIG. 7, the decision section 510 may decide whether or not the value obtained by subtracting ΔLmin from the target interval Lt is greater than or equal to a predetermined interval. Note that ΔLmin is the upper limit value of a potential error in the measurement value Lmsr of the length of the preceding sheet in the conveyance direction measured by the top sensor 107, and has been obtained at the time of factory shipment. As described for step S13, the correction section 505 increases the reduction amount Q by the upper limit value ΔL if the value obtained by subtracting ΔLmin from the target interval Lt is greater than or equal to the predetermined interval. Consequently, the throughput improves. On the other hand, as described for step S14, the correction section 505 reduces the reduction amount Q by the upper limit value ΔL if the value obtained by subtracting ΔLmin from the target interval Lt is not greater than or equal to the predetermined interval. Consequently, the paper discharge sensor 109 becomes able to detect the sheet interval. Note that the upper limit value ΔL may be determined in advance based on variations in the shape of the plurality of members that constitute the top sensor 107, the attachment tolerances of the plurality of members, and variations in the orientation of the sheet moving past the top sensor 107.

Various types of sheet sensors may be adopted as the top sensor 107. As described with reference to FIG. 4A and so on, the top sensor 107 may have the flag 402 that rotates about the rotation shaft 403 by being pressed by the leading end of the sheet S. Furthermore, the top sensor 107 may have the photointerrupter 401 that switches between the light blocking state and the light transmitting state according to the phase of the flag 402. As described with reference to FIG. 4A and so on, the flag 402 may rotate in a first direction by being pressed by the leading end of the sheet S, and rotate in a second direction that is opposite to the first direction upon the trailing end of the sheet S moving past the flag 402.

As described with reference to FIG. 8A and so on, the cam 1001 that regulates the flag 903 such that the flag 903 rotates by a predetermined angle each time a sheet S moves past the flag 903 may also be provided.

In the above-described embodiments, it is assumed that the conveyance control section 202 reduces the interval between the preceding sheet and the succeeding sheet by accelerating the succeeding sheet upon the top sensor 107 detecting the succeeding sheet. However, the conveyance control section 202 may enlarge the interval between the preceding sheet and the succeeding sheet by decelerating the succeeding sheet upon the top sensor 107 detecting the succeeding sheet. If this is the case, the above-described adjustment amount is an increase amount or an enlargement amount. In either case, the present invention is applicable to conveyance control by which the sheets are accelerated or decelerated in order to adjust the sheet interval to be a predetermined interval. The above-described embodiments are based on the premise that the minimum paper interval that the top sensor 107 can detect is shorter than the minimum paper interval that the paper discharge sensor 109 can detect. However, such limitation is not essential to the present invention. The conveyance control section 202 may detect that the error in the measurement value of the length of the preceding sheet is too large relative to the length of the preceding sheet in the conveyance direction (the nominal value) (i.e., the error is greater than a predetermined threshold value). In such a case, the conveyance control section 202 decides that a sheet size mismatch error (size error) has occurred, and stops the image forming operations including sheet conveyance. Note that the error described in the embodiments above is an error that does not cause a size error.

Figure 11:
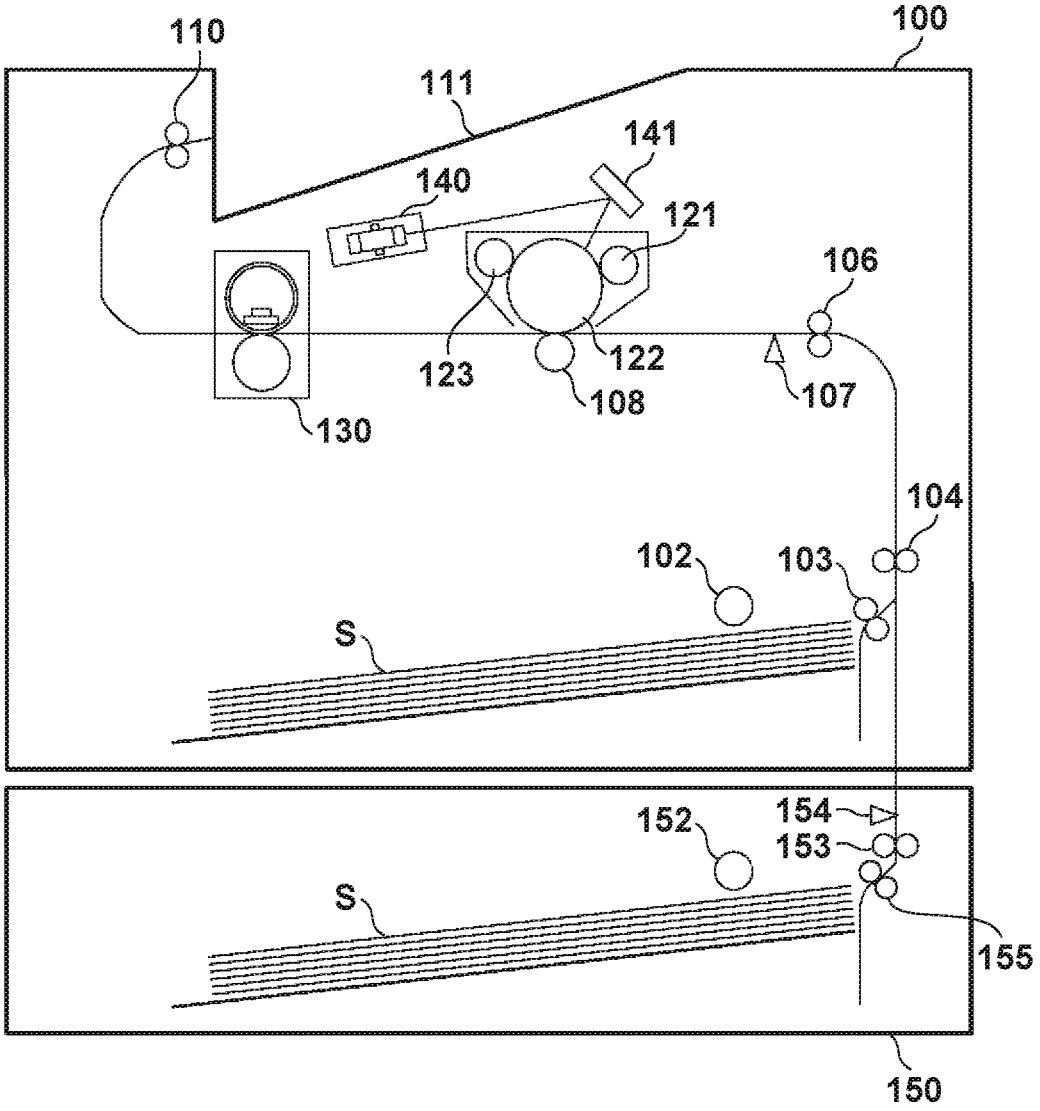
FIG. 11 is a cross-sectional view showing an example of an image forming apparatus.

FIG. 11 shows the image forming apparatus 100 to which a paper feed option 150 is attached. The paper feed option 150 is a feed device or a sheet conveyance device that houses and feeds sheets S having a size that is the same as or different from the standard cassette size. The sheets S are fed one by one as a paper feed roller 152 rotates. That is, the sheets S housed in a paper feed cassette are picked up by the paper feed roller 152 and separated from each other by a separation roller 155, and each sheet S is fed to the conveyance path. A conveyance roller 153 feeds the sheet S received from the paper feed roller 152 via the separation roller 155 to the conveyance roller 104. The conveyance roller 104 feeds the sheet S to the registration roller 106. Consequently, an image is also formed on the sheet S supplied from the paper feed option 150. A paper feed sensor 154 is a sensor for detecting the sheet that has been fed from the paper feed option 150 to the image forming apparatus 100, and can function as the above-described first detection unit. If this is the case, the above-described top sensor 107 or paper discharge sensor 109 may function as the second detection unit.

Figure 12A:
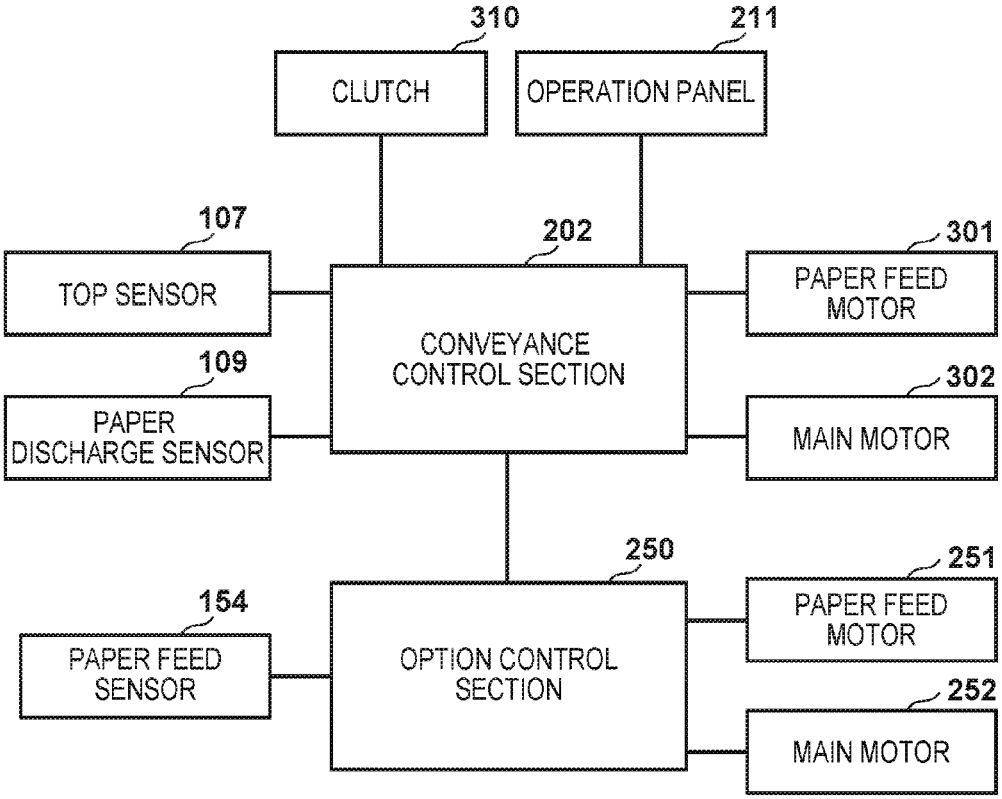
FIGS. 12A and 12B are block diagrams showing a control system.

FIG. 12A shows an option control section 250 that controls the paper feed option 150. Upon receiving a paper feed instruction from the conveyance control section 202, the option control section 250 rotates a paper feed motor 251 and thereby causes the paper feed motor 251 to rotate the paper feed roller 152. Consequently, the sheet S is fed. Furthermore, the option control section 250 drives a main motor 252, and thereby rotates the conveyance roller 153. Consequently, the sheet S is conveyed to the image forming apparatus 100. Note that the option control section 250 notifies the conveyance control section 202 of the fact that the leading end or the trailing end has been detected by the paper feed sensor 154. Consequently, the conveyance control section 202 becomes able to recognize the positions of the leading end and the trailing end of the sheet S supplied from the paper feed option 150.

Figure 12B:
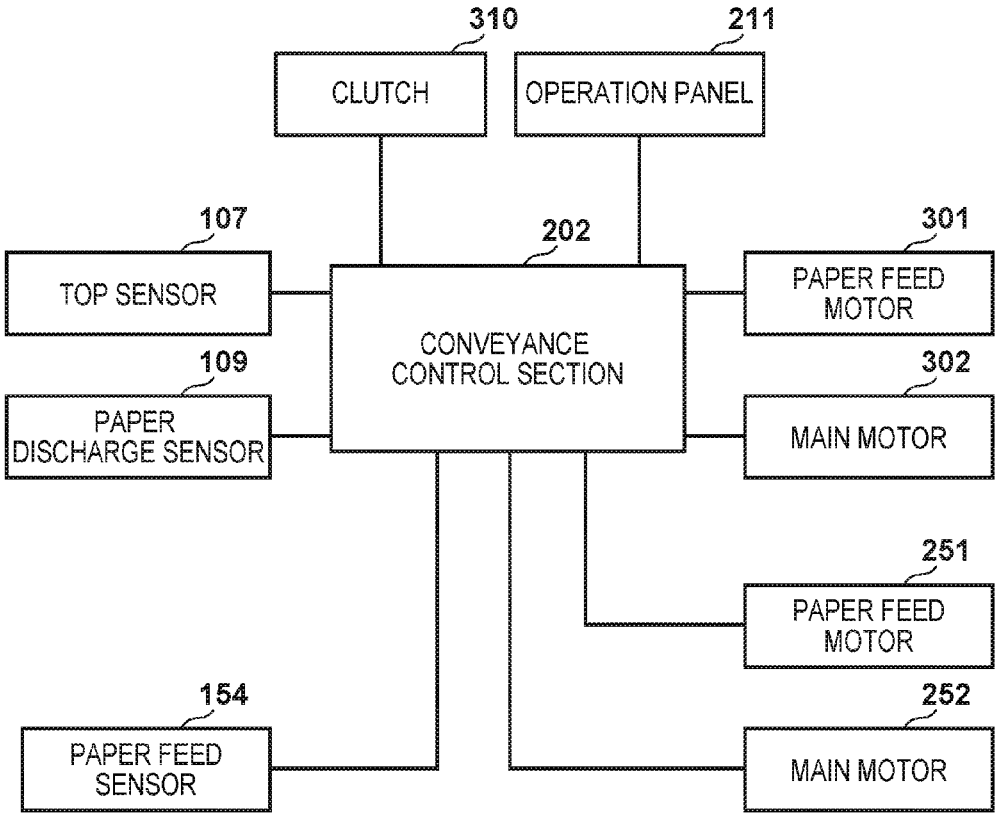

FIG. 12B shows that the option control section 250 is omitted and the conveyance control section 202 connects to, and directly controls, the paper feed motor 251, the main motor 252, and the paper feed sensor 154. In this way, the conveyance control section 202 provided in the image forming apparatus 100 may directly control the paper feed option 150.

The above-described sheet conveyance control is also applicable to the paper feed option 150. The conveyance roller 153 is an example of a conveyance unit that conveys a sheet in the conveyance path. The paper feed sensor 154 is an example of a detection unit that detects a sheet in the conveyance path. The option control section 250 or the conveyance control section 202 is an example of a determination unit (e.g. the determination section 504) that determines an adjustment amount for adjusting the interval from the trailing end of the preceding sheet to the leading end of the succeeding sheet according to the difference between the interval from the trailing end of the preceding sheet to the leading end of the succeeding sheet measured based on the result of detection by the paper feed sensor 154, and the target interval. The option control section 250 or the conveyance control section 202 is an example of a correction unit (e.g., the correction section 505) that corrects the adjustment amount according to the error in the measurement value of the length of the preceding sheet in the conveyance direction measured based on the result of detection by the detection unit, relative to the reference value of the length of the preceding sheet in the conveyance direction. The option control section 250 or the conveyance control section 202 is an example of a control unit (e.g., the motor control section 507) that controls the conveyance unit such that the conveyance speed of the conveyance unit is accelerated or decelerated during a period of time corresponding to the adjustment amount corrected by the correction unit. Note that some or all of the functions of the conveyance control section 202 shown in FIG. 10 may be realized by the option control section 250.

Although only one sheet sensor (the paper feed sensor 154) is provided in FIG. 11, the paper feed option 150 may have a plurality of sheet sensors. If this is the case, a sheet sensor that is disposed at an upstream position in the sheet conveyance direction functions as the above-described first detection unit, and a sheet sensor that is disposed at a downstream position functions as the above-described second detection unit. The option control section 250 performs sheet conveyance control using these two sheet sensors, and this conveyance control may be the same as the conveyance control performed by the conveyance control section 202.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2015-124163 filed Jun. 19, 2015 and 2016-106716 filed May 27, 2016, which are hereby incorporated by reference herein in their entirety.

What is claimed is:

1. An image forming apparatus, comprising:

a conveyance unit configured to convey a sheet on a conveyance path;

a first detection unit configured to detect a sheet on the conveyance path;

a determination unit configured to determine an adjustment amount for adjusting an interval from a trailing end of a preceding sheet to a leading end of a succeeding sheet according to a difference between a measurement interval from the trailing end of the preceding sheet to the leading end of the succeeding sheet, measured based on a result of detection by the first detection unit, and a target interval;

a correction unit configured to correct the adjustment amount according to a difference between a measurement value of a length of the preceding sheet in a conveyance direction, measured based on the result of detection by the first detection unit, and a reference value of the length of the preceding sheet in the conveyance direction; and a control unit configured to control the conveyance unit such that a conveyance speed of the conveyance unit is accelerated or decelerated during a period of time that corresponds to the adjustment amount corrected by the correction unit.

2. The image forming apparatus according to claim 1, further comprising:

a second detection unit disposed downstream of the first detection unit in the conveyance direction of the conveyance path, and configured to detect a sheet, wherein the correction unit is further configured to correct the adjustment amount according to the difference between the measurement value and the reference value so as to allow the second detection unit to detect the trailing end of the preceding sheet and the leading end of the succeeding sheet.

3. The image forming apparatus according to claim 2, further comprising:

a decision unit configured to decide whether or not the second detection unit can detect the trailing end of the preceding sheet and the leading end of the succeeding sheet even upon the interval from the trailing end of the preceding sheet to the leading end of the succeeding sheet being reduced by the difference between the measurement interval and the target interval and the difference between the measurement value and the reference value, based on the target interval, the difference between the measurement value and the reference value, and a predetermined interval that allows the second detection unit to detect the trailing end of the preceding sheet and the leading end of the succeeding sheet, wherein the correction unit is further configured to increase, maintain, or reduce the adjustment amount depending on a result of decision by the decision unit.

4. The image forming apparatus according to claim 2, further comprising:

a first decision unit configured to decide whether or not the measurement value of the length of the preceding sheet in the conveyance direction measured based on the result of detection by the first detection unit is greater than or equal to the reference value of the length of the preceding sheet in the conveyance direction; and a second decision unit configured to decide whether or not a difference obtained by subtracting the difference between the measurement value and the reference value from the target interval is greater than or equal to a predetermined interval that allows the second detection unit to detect the trailing end of the preceding sheet and the leading end of the succeeding sheet upon the measurement value being greater than or equal to the reference value, wherein the correction unit is further configured to increase the adjustment amount upon the difference obtained by subtracting the difference between the measurement value and the reference value from the target interval being greater than or equal to the predetermined interval, and is further configured not to correct the adjustment amount upon the measurement value being greater than or equal to the reference value and the difference obtained by subtracting the difference between the measurement value and the reference value from the target interval is not greater than or equal to the predetermined interval.

5. The image forming apparatus according to claim 4, wherein the correction unit is further configured to increase the adjustment amount by the difference between the measurement value and the reference value upon the measurement value being greater than or equal to the reference value and the difference obtained by subtracting the difference between the measurement value and the reference value from the target interval is greater than or equal to the predetermined interval.

6. The image forming apparatus according to claim 4, further comprising:

a third decision unit configured to decide whether or not a difference obtained by subtracting the difference between the measurement value and the reference value from the target interval is smaller than or equal to the predetermined interval, wherein the correction unit is further configured not to correct the adjustment amount upon the measurement value being not greater than or equal to the reference value and the difference obtained by subtracting the difference between the measurement value and the reference value from the target interval being smaller than or equal to the predetermined interval, and is further configured to reduce the adjustment amount upon the measurement value being not greater than or equal to the reference value, and the difference obtained by subtracting the difference between the measurement value and the reference value from the target interval being not smaller than or equal to the predetermined interval.

7. The image forming apparatus according to claim 4, wherein the correction unit is further configured to reduce the adjustment amount by a difference obtained by subtracting the measurement value from the reference value upon the measurement value being not greater than or equal to the reference value and the difference obtained by subtracting the difference between the measurement value and the reference value from the target interval being not smaller than or equal to the predetermined interval.

8. The image forming apparatus according to claim 1, wherein the control unit is further configured to increase the conveyance speed of the conveyance unit from a first conveyance speed to a second conveyance speed during the period of time that corresponds to the adjustment amount, the first conveyance speed being determined based on a throughput of the image forming apparatus, and the second conveyance speed being faster than the first conveyance speed.

9. The image forming apparatus according to claim 8, wherein the control unit is further configured to: linearly increase the conveyance speed of the conveyance unit during a first time period; maintain the conveyance speed of the conveyance unit to be the second conveyance speed during a second time period; and linearly reduce the conveyance speed of the conveyance unit back to the first conveyance speed during a third time period, the first time period starting from when the control unit starts increasing the conveyance speed of the conveyance unit, the second time period starting from when the conveyance speed of the conveyance unit reaches the second conveyance speed, and the third time period being subsequent to the second time period.

10. The image forming apparatus according to claim 1, further comprising:

an obtaining unit configured to obtain the reference value of the length of the preceding sheet in the conveyance direction based on a size of the sheet specified by an operator.

11. The image forming apparatus according to claim 2, further comprising:

a decision unit configured to decide whether or not a value obtained by subtracting an upper limit value of a potential error in the measurement value of the length of the preceding sheet in the conveyance direction measured by the first detection unit from the target value is greater than or equal to a predetermined interval that allows the second detection unit to detect the trailing end of the preceding sheet and the leading end of the succeeding sheet, wherein the correction unit is further configured to increase the adjustment amount upon a value obtained by subtracting the upper limit value from the target interval being greater than or equal to the predetermined interval, and reduce the adjustment amount upon the value obtained by subtracting the upper limit value from the target interval being not greater than or equal to the predetermined interval.

12. The image forming apparatus according to claim 11, wherein the correction unit is further configured to increase the adjustment amount by the upper limit value upon the value obtained by subtracting the upper limit value from the target interval being greater than or equal to the predetermined interval, and reduce the adjustment amount by the upper limit value upon the value obtained by subtracting the upper limit value from the target interval being not greater than or equal to the predetermined interval.

13. The image forming apparatus according to claim 11, wherein the upper limit value is determined in advance based on variations in a shape of a plurality of members that constitute the first detection unit, attachment tolerances of the plurality of members, and variations in an orientation of a sheet moving past the first detection unit.

14. The image forming apparatus according to claim 1, wherein the first detection unit includes:

a flag configured to rotate about a rotation shaft by being pressed by a leading end of a sheet, and a photointerrupter configured to switch between a light blocking state and a light transmitting state according to a phase of the flag.

15. The image forming apparatus according to claim 14, wherein the flag is further configured to rotate in a first direction by being pressed by the leading end of the sheet, and rotate in a second direction opposite to the first direction upon the trailing end of the sheet moving past the flag.

16. The image forming apparatus according to claim 14, further comprising:

a cam mechanism configured to regulate the flag such that the flag rotates by a predetermined angle each time a sheet moves past.

17. A sheet conveyance device, comprising:

a conveyance unit configured to convey a sheet on a conveyance path;

a detection unit configured to detect a sheet on the conveyance path;

a determination unit configured to determine an adjustment amount for adjusting an interval from a trailing end of a preceding sheet to a leading end of a succeeding sheet according to a difference between a measurement interval from the trailing end of the preceding sheet to the leading end of the succeeding sheet, measured based on a result of detection by the detection unit, and a target interval;

a correction unit configured to correct the adjustment amount according to a difference between a measurement value of a length of the preceding sheet in a conveyance direction, measured based on the result of detection by the detection unit, and a reference value of the length of the preceding sheet in the conveyance direction; and a control unit configured to control the conveyance unit such that a conveyance speed of the conveyance unit is accelerated or decelerated during a period of time that corresponds to the adjustment amount corrected by the correction unit.

* * * * *